US006584653B1

(12) United States Patent
Riley

(10) Patent No.: US 6,584,653 B1
(45) Date of Patent: Jul. 1, 2003

(54) BUTTON COMBINATION

(75) Inventor: Hedley Godfried Riley, Amsterdam (NL)

(73) Assignee: Decall Enterprises Ltd., Amsterdam (NL)

( * ) Notice: Subject to any disclaimer, the term of this patent is extended or adjusted under 35 U.S.C. 154(b) by 0 days.

(21) Appl. No.: 09/509,985

(22) PCT Filed: Aug. 31, 1998

(86) PCT No.: PCT/NL98/00488

§ 371 (c)(1),
(2), (4) Date: Apr. 5, 2000

(87) PCT Pub. No.: WO99/11154

PCT Pub. Date: Mar. 11, 1999

(51) Int. Cl.[7] ..... A44B 1/34
(52) U.S. Cl. ..... 24/104; 24/90.1
(58) Field of Search ..... 24/662, 669, 670, 24/702, 572.1, 589.1, 590.1, 595.1, 667, 683, 700, 701, 103, 114.4

(56) References Cited

U.S. PATENT DOCUMENTS

| | | | | | |
|---|---|---|---|---|---|
| 754,125 | A | * | 3/1904 | Capewell | 24/114.4 |
| 1,200,888 | A | * | 10/1916 | Schodsky | 24/669 |
| 1,428,358 | A | * | 9/1922 | Burbery | 24/702 |
| 1,507,817 | A | * | 9/1924 | Day | 24/702 X |
| 2,015,559 | A | | 9/1935 | Holm | 24/109 |
| 2,041,624 | A | * | 5/1936 | Samuel | 24/702 X |
| 2,815,554 | A | | 12/1957 | Pieper | 24/243 |
| 2,866,246 | A | * | 12/1958 | Waldes | 24/669 |
| 3,028,646 | A | * | 4/1962 | Janes | 24/114.4 |
| 3,313,008 | A | * | 4/1967 | Littell et al. | 24/669 |
| 3,474,504 | A | * | 10/1969 | Holdsworth | 24/114.4 |
| 3,984,191 | A | * | 10/1976 | Doty | 403/69 |
| 4,704,772 | A | * | 11/1987 | Kasai | 24/669 |
| 4,932,105 | A | * | 6/1990 | Muller | 24/701 X |
| 5,106,223 | A | * | 4/1992 | Kraus | 403/11 |
| 5,566,430 | A | * | 10/1996 | Cheng | 24/595.1 |
| 5,651,632 | A | * | 7/1997 | Gordon | 403/319 |
| 6,305,588 | B1 | * | 10/2001 | Michel et al. | 221/271 |

FOREIGN PATENT DOCUMENTS

FR A794257 A 2/1936

* cited by examiner

*Primary Examiner*—Robert J. Sandy
*Assistant Examiner*—Ruth C. Rodriguez
(74) *Attorney, Agent, or Firm*—Knoble & Yoshida LLC

(57) ABSTRACT

A button combination includes a base part to be attached to an article of clothing and a main part to be detachably connected to the base part (1). The main part (8) is provided with two disc-shaped portions (9, 9') extending parallel to each other, which disc-shaped portions are interconnected near their circumference (10) over part thereof. A recess (11) is provided in one of the disc-shaped portions, which recess is open at an edge of the disc-shaped portion in question. The base part (1) includes two parallel disc-shaped portions (2, 3), which are interconnected by a connecting piece (5), all this in such a manner that in order to interconnect the base part and the main part, the connecting piece (5) of the base part is inserted into the recess in the main part with a clamped fit.

6 Claims, 3 Drawing Sheets

BUTTON COMBINATION

The invention relates to a button combination comprising a base part to be attached to an article of clothing and a main part to be detachably connected to said base part. Button combinations of this kind, which are for example used for interchangeably placing decorative buttons on the base part, are known from International patent application WO 96/05749 and European patent application no. 0 664 971.

With the button combination according to WO 96/05749, a conventional button is used as the base part, which button is provided with a few holes for passing yarn therethrough, by means of which yarn the button is fixed to an article of clothing in a usual manner. The main part to be placed on the base part, which forms a decorative button or the like, is provided with bar-shaped parts, which, in order to fix the main part to the base part, must be passed through the openings provided in the base part for passing the fixing yarn therethrough. The bar-shaped portions are thereby provided with barbs at their free ends, which barbs engage behind the base part when the main part is placed on the base part. When the main part is to be detached from the base part, the barbs engaging behind said base part must be moved towards each other. This is difficult, and generally it will only be possible if the base part is attached relatively loosely to the article of clothing by means of the fixing yarn, so that sufficient space is present between the side of a base part that faces an article of clothing and the article of clothing itself. When the base part is loosely attached in this manner, articles of clothing fitted with such a button combination will look slovenly, however.

With the construction according to European patent application no. 0 664 971, the base part is made up of a U-shaped element, which carries projecting arms at the free ends of its legs, which arms must be received in a circular groove formed in the main part, whereby the base part and the main part must be moved to a position in which they are fixed relative to each other by turning the two parts with respect to each other. The construction of the base part and the main part of this known construction is relatively complicated, whilst furthermore it is not possible to realise a firm attachment of the base part to the article of clothing so that the base part will take up a desired position relative to the article of clothing. Also with this construction, undesirable rotation of the base part relative to the article of clothing will rather occur, which will make articles of clothing fitted with such button combinations look slovenly.

According to the invention, the main part is provided with two disc-shaped portions extending parallel to each other, which disc-shaped portions are interconnected near their circumference over part thereof, wherein a recess is provided in one of said disc-shaped portions, which recess is open at an edge of the disc-shaped portion in question, whilst the base part comprises two parallel disc-shaped portions, which are interconnected by a connecting piece, all this in such a manner that in order to interconnect the base part and the main part, the connecting piece of the base part is inserted into the recess in the main part with a clamped fit, wherein one of the disc-shaped portions of the base part is positioned between the disc-shaped portions of the main part.

When using the construction according to the invention, the base part can be firmly attached to the article of clothing, in such a manner that one of the disc-shaped portions of the base part butts against a respective panel of the article of clothing and is fixed thereto. The other disc-shaped portion can be passed through a respective buttonhole when buttoning up the article of clothing in question. The disc-shaped portion that is passed through said buttonhole may be suitably shaped to conform to a large degree with conventional buttons used in shirts and the like, for example, so that the base part can also be used without using the main part, if desired. If it is desired to give the article of clothing an additional touch of distinction, a desired main part can be placed on the base part by simply sliding the main part onto the base part, whereby a firm anchoring between the main part and the base part can be realised.

The invention will be explained in more detail with reference to the accompanying figures, which diagrammatically show an embodiment of the button combination according to the invention.

Figure 1:
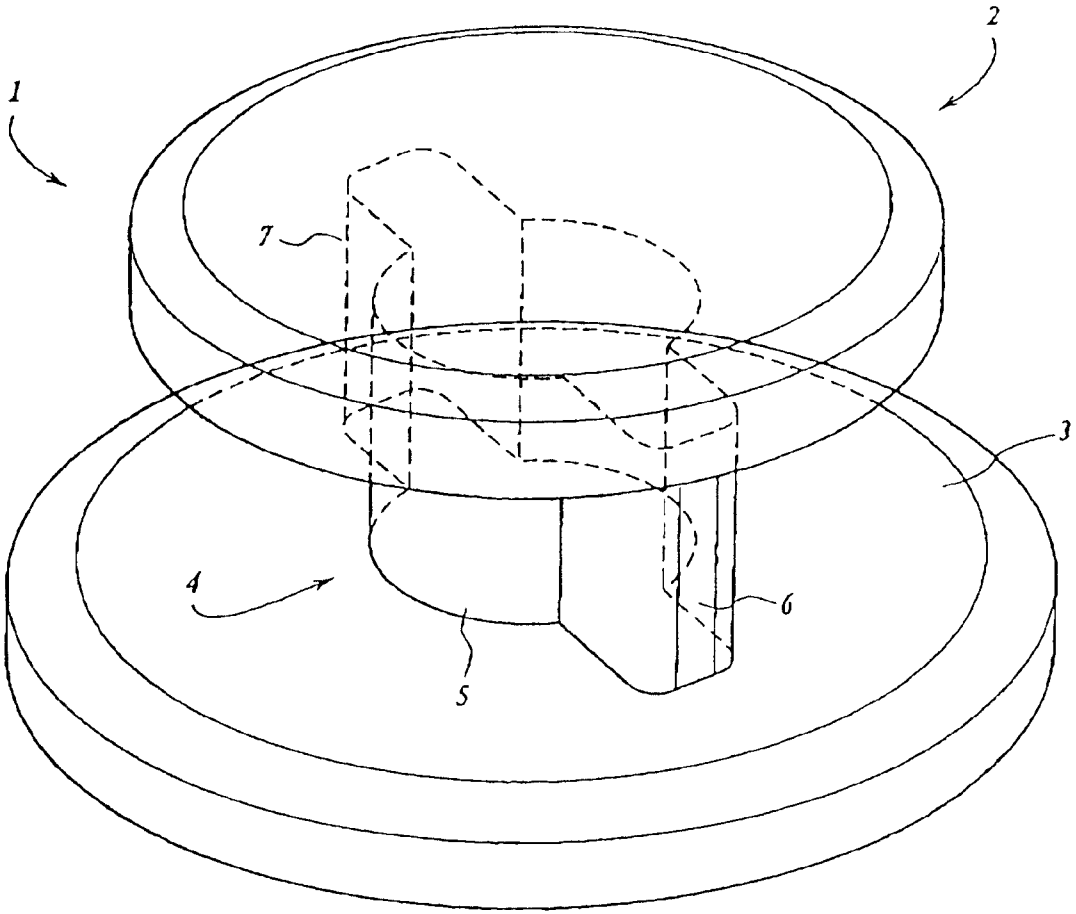
FIG. 1 is a perspective view of a base part of a button combination according to the invention.
Figure 2:
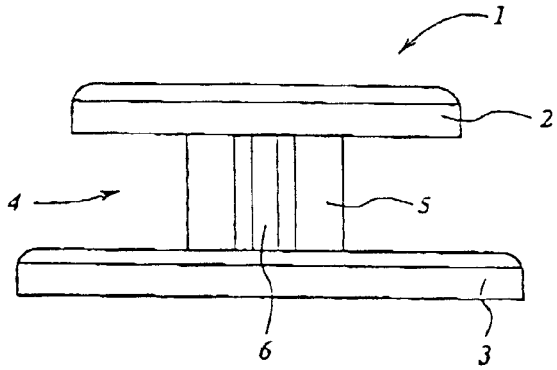
FIG. 2 is a smaller-scale side view of the base part shown in FIG. 1.

As is shown in FIGS. 1 and 2, a base part 1 comprises two parallel disc-shaped portions 2 and 3, whereby the upper portion 2 of the illustrated embodiment is slightly smaller than the lower portion 3, seen in sectional view.

The two disc-shaped portions 2 and 3 are interconnected by a connecting piece 4. Said connecting piece is comprised of a central portion 5 having a circular circumference and two diametrically opposed ribs 6 and 7 extending radially outwards from central portion 5, whose free ends are slightly rounded.

Disc-shaped portion 3 may be provided with a few holes (not shown) extending through the disc-shaped portion for passing a fixing yarn, by means of which base part 1 can be attached to a panel of an article of clothing or the like, in such a manner that disc-shaped portion 3 firmly butts against said panel of said article of clothing, whilst disc-shaped portion 2 can be passed through a corresponding buttonhole when using the article of clothing.

Another possibility is to form a (preferably) blind hole in the central portion 5 of the connecting piece, which, seen in FIG. 1, extends a specified length from the underside of disc-shaped portion 3 through disc-shaped portion 3 and into central portion 5 of connecting piece 4. It is possible to insert into said hole the shank of a nail consisting of a shank and a head, in such a manner that a respective panel of an article of clothing or the like is clamped between the head of said nail and disc-shaped portion 3, whilst said shank is clampingly accommodated in the central portion 5 of connecting piece 4. Advantageous is the fact that several nails can be pressed into the respective base parts 1 simultaneously, for example by means of a simple set of press tools, so that a considerable amount of time is saved in comparison with conventional fixing operations.

Another possibility of providing the base parts is to glue the base parts to the article of clothing.

It will be apparent that a firm abutment of disc-shaped portion 3, and thus of base part 1, against a respective panel of an article of clothing can be ensured at all times, so that undesirable rotation or tilting of base part 3 with respect to the article of clothing will be avoided.

In particular when using the above-described nails, the risk of base parts becoming detached is practically excluded.

Disc-shaped portion 2 can be efficiently configured to have the shape of a simple button, for example buttons used on shirts or the like, setting aside the fact that disc-shaped portion 2 will not comprise the usual holes for the passage of a fixing yarn in that case. By configuring disc-shaped portion 2 to have such a shape resembling a conventional button, the base part can be used by itself.

Figure 3:
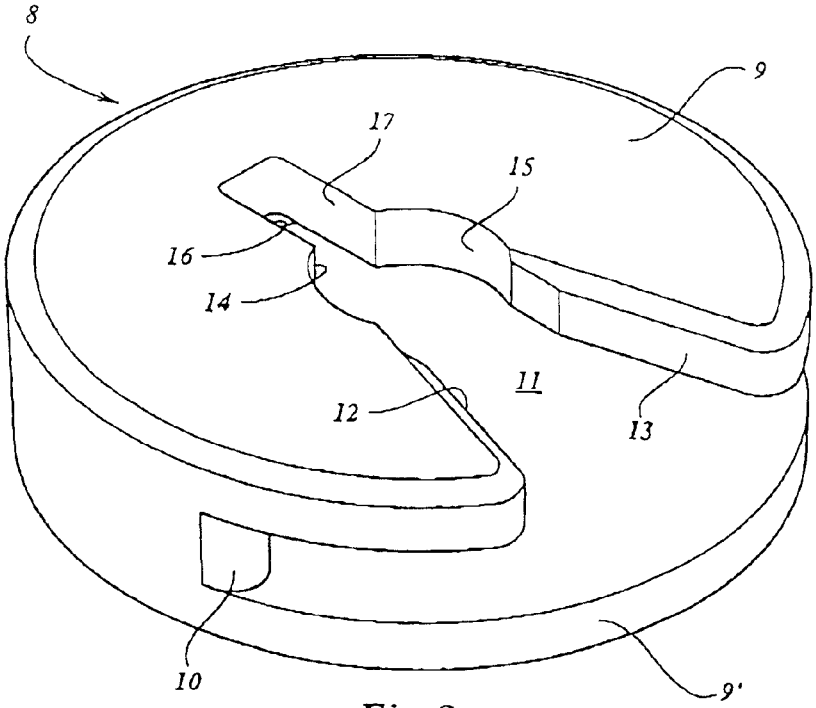
FIG. 3 is a perspective view of an embodiment of a main part for a button combination according to the invention.
Figure 4:
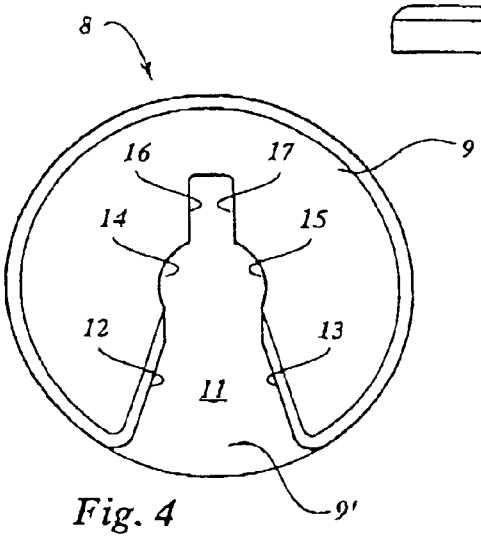
FIG. 4 is a smaller-scale plan view of FIG. 3.

In order to give the article of clothing an additional touch of distinction, the base part may be used in combination with a main part as shown diagrammatically in FIGS. 3 and 4.

As is shown in said figures, main part 8 comprises two disc-shaped portions 9 and 9' extending parallel to each other, and which are interconnected by a connecting rib 10, which is disposed near the circumference of said disc-shaped portions 9 and 9' and which extends over part of the circumference of said disc-shaped portions. A recess 11 is provided in disc-shaped portion 9, which recess 11 is open near one end of disc-shaped portion 9. Recess 11 is thereby bounded by two boundary surfaces 12 and 13, which extend obliquely towards each other from the outer circumference of disc-shaped portion 9. Near their ends remote from the circumferential edge of disc-shaped portion 9, boundary surfaces 12 and 13 blend into two curved boundary surfaces 14 and 15, which form a connection between boundary surfaces 12 and 13 and two parallel boundary surfaces 16 and 17 of recess 11.

Main part 8 of the button combination according to the invention can now be slid over base part 1, in such a manner that disc-shaped portion 2 of base part 1 will be positioned between disc-shaped portions 9 and 9' of main part 8. The connecting piece 4 of base part 1 will thereby be slid into recess 11, with rib 6 or rib 7 positioned in front. Said insertion of connecting piece 4 is facilitated by the funnel-shaped entry of recess 11. When main part 8 is slid completely over base part 1, the central portion 5 of connecting piece 4 will be positioned in that part of recess 11 which is bounded by boundary surfaces 14 and 15, whilst rib 6 or rib 7 will be positioned in that part of recess 11 which is bounded by boundary surfaces 16 and 17.

Main part 8 is thereby locked against rotation with respect to the base part, whilst some deformation of portion 5 of connecting piece 4 and/or of boundary surfaces 12, 13 of recess 11 must take place before inserting central portion 5 into the part of recess 11 that is bounded by boundary surfaces 14 and 15, so that connecting piece 4 will be accommodated in recess 11 with a clamped fit, and main part 8 can only be removed from base part 1 by exerting a specific force.

When main part 8 is present on base part 1, disc-shaped portion 9' will be exposed to view when the article of clothing is being worn. Said disc-shaped portion 9' itself may be a decorative button or the like, or it may function to detachably accommodate a decorative button.

Figure 5:
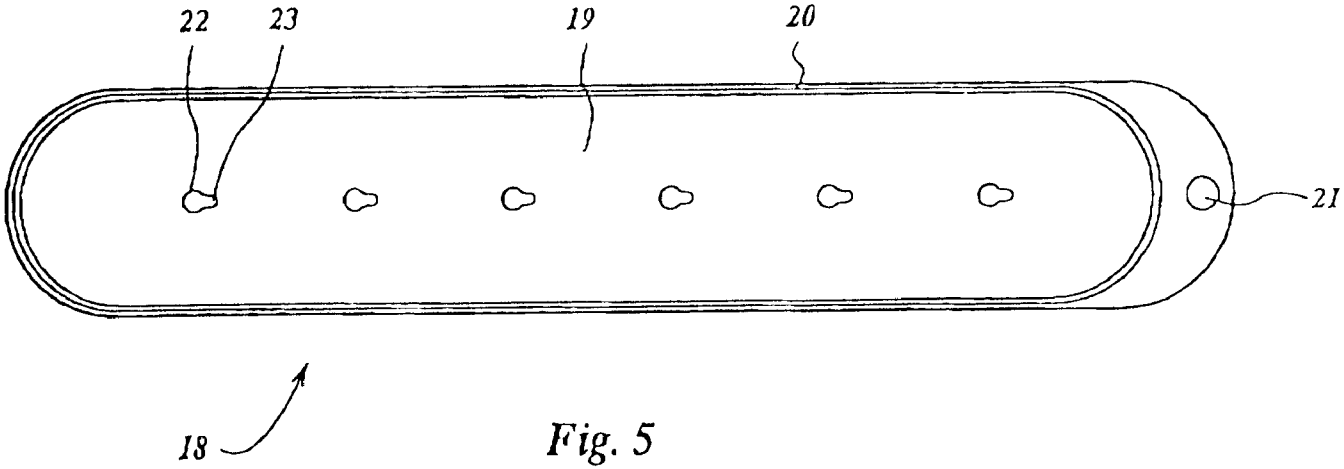
FIG. 5 is a plan view of a box for storing main parts.
Figure 6:
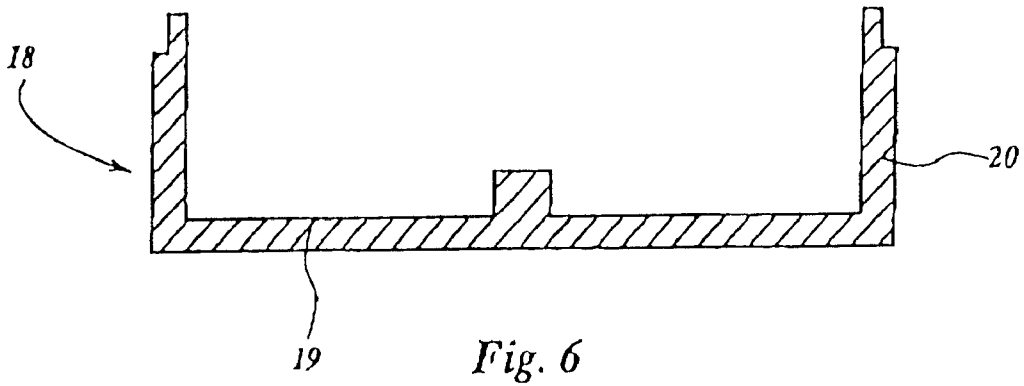
FIG. 6 is a larger-scale, sectional view of FIG. 5.

FIGS. 5 and 6 diagrammatically show a storage box 18 for main parts 8 of a button combination according to the invention.

As is shown in said figures, the box comprises a bottom 19 and a continuous upright wall 20, which comprises a thinner upper end for the purpose of placing a cover (not shown) thereon. Bottom 19 may project from circular wall 20 at one end, as is shown in FIG. 5, whereby said end is provided with a hole 21, which makes it possible to suspend the box from a post or the like.

One or more projections 22, six in the illustrated embodiment, which are substantially circular in section, are provided in the interior of the box, each of said projections being provided with a projecting rib 23 on one side, in such a manner that ribs 23 are in line. The shape and the dimension of projection 22 largely corresponds with the shape and the dimension of central portion 5 of the above-described connecting piece 4, whilst ribs 23 correspond with a rib 6 and a rib 7 respectively as regards their shape and dimension. It will be apparent, that the above-described main parts 8 can thus be slid onto connecting pieces 22, 23 present on the bottom 19 of storage box 18 in a simple manner.

What is claimed is:

1. A button combination comprising a base part attached to an article of clothing and a main part to be detachably connected to said base part, wherein said main part comprises first and second disc-shaped portions extending parallel to each other, said first and second disc-shaped portions are interconnected near their circumference over part thereof, where in a recess is provided in said first disc-shaped portion, said recess is open at an edge of the disc-shaped portion in question, wherein said base part comprises two parallel disc-shaped portions, which are interconnected by a connecting piece, all this in such a manner that in order to interconnect said base part and said main part, the connecting piece of the base part is inserted into the recess in the main part with a clamped fit, wherein one of the disc-shaped portions of the base part is positioned between the first and second disc-shaped portions of the main part and, said connecting piece of said base part comprises a central portion having an at least substantially circular cross-section and at least one rib extending radially with respect thereto.

2. A button combination according to claim 1, characterized in that a blind bore is provided in a centre of the central middle portion of the connecting piece.

3. A button combination according to claim 1, characterized in that said connecting piece comprises two ribs which are positioned diametrically opposite each other with respect to a central middle portion of said connecting piece, and which extend radially outwards from said connecting piece.

4. A button combination according to claim 3, characterized in that a blind bore is provided in a center of the central middle portion of the connecting piece.

5. A button combination according to claims 1, 3, 2 or 4, characterized in that the recess in the first disc-shaped portion of the main part gradually narrows from it's end located at the circumference of the first disc-shaped portion towards the centre of the first disc-shaped portion, eventually blending into a portion whose shape is adapted to the central middle portion of the base part, whilst the end of the recess is formed by a portion which can receive a rib-shaped portion of the connecting piece.

6. A box for storing main parts of a button combination according to claims 1, 3, 2 or 4, characterized in that said box comprises at least one projection, which fits in the recesses formed in the main parts with a close fit.

* * * * *